US011484459B2

(12) United States Patent
Rahman et al.

(10) Patent No.: US 11,484,459 B2
(45) Date of Patent: Nov. 1, 2022

(54) ELBOW FLEXION-ASSIST APPLIANCE

(71) Applicant: THE NEMOURS FOUNDATION, Jacksonville, FL (US)

(72) Inventors: Tariq Rahman, Wilmington, DE (US); Jinyong Wee, Berwyn, PA (US)

(73) Assignee: THE NEMOURS FOUNDATION, Jacksonville, FL (US)

( * ) Notice: Subject to any disclaimer, the term of this patent is extended or adjusted under 35 U.S.C. 154(b) by 409 days.

(21) Appl. No.: 16/871,729

(22) Filed: May 11, 2020

(65) Prior Publication Data

US 2020/0268586 A1 Aug. 27, 2020

Related U.S. Application Data

(63) Continuation-in-part of application No. 16/012,319, filed on Jun. 19, 2018, now abandoned.

(60) Provisional application No. 62/521,761, filed on Jun. 19, 2017.

(51) Int. Cl.
*A61H 1/02* (2006.01)

(52) U.S. Cl.
CPC ..... *A61H 1/0277* (2013.01); *A61H 2201/12* (2013.01); *A61H 2201/165* (2013.01); *A61H 2201/1638* (2013.01)

(58) Field of Classification Search
CPC ..... A61H 1/0277; A61F 5/0102; A61F 5/013; A61F 2/54; A61F 2/58
See application file for complete search history.

(56) References Cited

U.S. PATENT DOCUMENTS

| | | | |
|---|---|---|---|
| 5,472,410 | A | 12/1995 | Hamersly |
| 6,245,034 | B1 | 6/2001 | Bennett et al. |
| 7,601,130 | B2 | 10/2009 | Farrell et al. |
| 9,114,277 | B2 | 8/2015 | Goeckel |

OTHER PUBLICATIONS

Chomiak et al., "Restoration of elbow joint flexion using pectoral muscle transfer in patients with arthrogryposis multiplex congenita. Part I: surgical method, rehabilitation and clinical results"; Acta Chir Orthop Traumatol Cech. 2002;69(6): 333-43, 2 pages.

Vermaak, DP, "Arthrogryposis multiplex congenita of the upper limb"; SA Orthopaedic Journal Autumn 2012/vol. II, No. 1, pp. 34-39.

Axt et al., "Principles of treatment of the upper extremity in arthrogryposis multiplex congenita type I."; J Pediatr Orthop B.; Jul. 1997;6(3):179-85; 1 page.

*Primary Examiner* — Marcia L Watkins

(74) *Attorney, Agent, or Firm* — Faegre Drinker Biddle & Reath LLP

(57) ABSTRACT

An elbow joint boost device has first and second frames to be attached to the forearm and lower arm of a patient. A guide mounted on the first frame extends generally along the respective one of the forearm and upper arm. A link is mounted on the guide for sliding movement along the guide, and a spring acts in tension between the sliding link and a point on the second frame remote from the patient's elbow. As the patient straightens and bends the elbow, the link can slide along the guide, varying the leverage of the tension spring.

9 Claims, 4 Drawing Sheets

FIG. 1
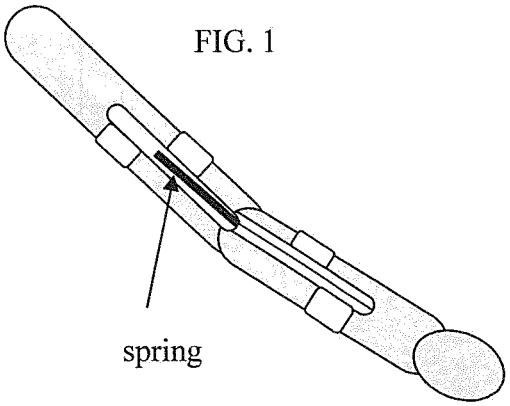
FIG. 3
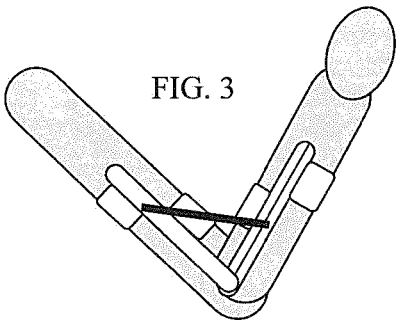
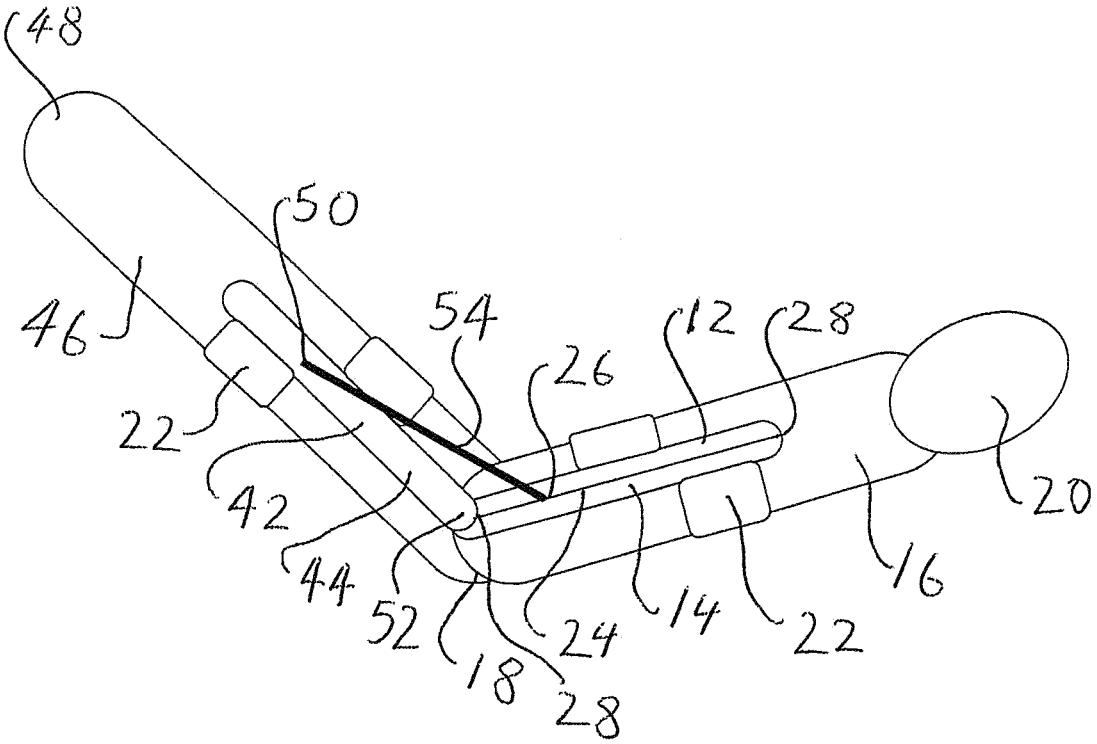
FIG. 2

ELBOW FLEXION-ASSIST APPLIANCE

RELATED APPLICATIONS

The present application is a continuation-in-part of U.S. application Ser. No. 16/012,319, filed on Jun. 19, 2018, which claims priority from U.S. Provisional application No. 62/521,761, filed on Jun. 19, 2017, the disclosure of both applications are incorporated herein by reference in their entirety.

FIELD OF THE INVENTION

The invention relates to assisting the movement of persons with weak muscles, and especially to a method of and appliance for assisting the elbow movement of a person with a weak biceps muscle.

BACKGROUND

Arthrogryposis Multiplex Congenita (AMC) is a rare congenital disease that occurs in 1 of every 3000 births. See M. W. Axt, F. U. Niethard, L. Doderlein, and M. Weber, "Principles of treatment of the upper extremity in arthrogryposis multiplex congenita type I," *J. Pediatr. Orthop. B.*, vol. 6, no. 3, pp. 179-185, Jul. 1997. Symptoms are muscle weakness and joint stiffness. Patients with this condition typically have weak biceps and shoulder muscles. They are unable to raise their hand more than 20 or 30 deg from full extension. Although their shoulder is relatively stronger it is still difficult for them to bring their hand up to beyond their waist. This impairment can make feeding difficult.

The condition is often accompanied by mild to severe joint contractures that limit their passive range of motion. Depending on the severity of the condition, a child could be ambulatory or use a wheelchair. Performing activities of daily living and communication can be problematic for this population.

Children with this condition commonly resort to compensatory movements to help with eating and any activity involving bending the elbow, for example, by using the other hand to help bend the elbow, or by propping the elbow against a table. Their triceps muscle is typically strong so they are able to extend the elbow normally. Children with AMC would benefit from a device that helps them flex their elbow. However, the device has to be inconspicuous and very functional or it will likely be rejected, as it is not a necessity for function.

Devices on the market that address elbow limitations include the MyoPro® myoelectric upper limb orthosis, from Myomo. That orthosis is a rigid brace used for the purpose of supporting a patient's weak or deformed arm to enable functional activities and is motorized and operated by myoelectric signals from the patient's muscles. An alternative approach, of which the Roylan Multi-Use Elbow is an example, merely immobilizes or blocks out undesired elbow motion.

There is nothing on the market to our knowledge that passively (without external energy such as motors) assists the elbow in flexion.

SUMMARY

One aspect of the present disclosure proposes a simple elbow joint appliance that provides a boost when the elbow is bent beyond a certain angle. The boost assists in bringing the hand close to the mouth with very little effort. This is done using a combination of a spring and a sliding link. In the reverse motion, the person has enough strength in the triceps muscle to overcome the spring and straighten the elbow easily. When the elbow is straight there is no pulling force. The pulling force only activates at a certain elbow angle.

A novel feature of the device is the sliding connection.

Another aspect of the present disclosure provides a joint boost device, comprising first and second frames, attachable to first and second body parts of a patient, wherein the first and second body parts are connected by a joint, a guide mounted on the first frame to extend generally towards and away from the joint when the device is attached to the patient, a link mounted on the guide for movement along the guide, and a spring acting in tension between the sliding link and a point on the second frame remote from said joint.

Another aspect of the present disclosure provides an elbow joint boost device, comprising first and second frames, each attachable to a respective one of the upper and lower arms of a patient, a guide mounted on the first frame to extend generally along the respective one of the upper and lower arms when the device is attached to the patient, a link mounted on the guide for sliding movement along the guide, and a spring acting in tension between the sliding link and a point on the second frame remote from the patient's elbow.

The elbow joint device assists subjects in flexing their elbow and allowing them to reach their mouth in a relatively 'normal' motion. Subjects have enough strength in their triceps muscle to straighten the elbow against the force of the spring. During the straightening motion, the triceps stores energy in the spring, which is then available to boost the biceps during the next bending motion. The spring force and placement are such that a specified force is applied to the elbow only in a certain range of movement. The force gradually increases as the hand gets closer to the mouth.

BRIEF DESCRIPTION OF THE DRAWINGS

FIG. 1 is a diagram of an embodiment of a joint device attached to an arm with the elbow straight.

FIG. 2 is a diagram similar to FIG. 1, with the elbow partly bent.

FIG. 3 is a diagram similar to FIG. 1, with the elbow fully bent.

DESCRIPTION OF THE EMBODIMENTS

Figure 4:
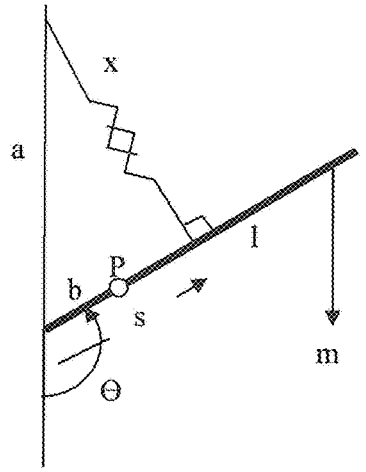
FIG. 4 is a force diagram.

Referring to the drawings, and initially to FIGS. 1 to 3, one embodiment of a joint boost device comprises a first frame 12 comprising a first rail 14 that in use extends along a patient's forearm 16 from the elbow 18 about halfway to the hand 20, and one or more straps or clamps 22 that secure the rail 14 in an essentially fixed position relative to the forearm 16. The straps or clamps 22 may be of any convenient design, including designs already well known in the art and, in the interests of conciseness, are not further discussed here.

Figure 7:
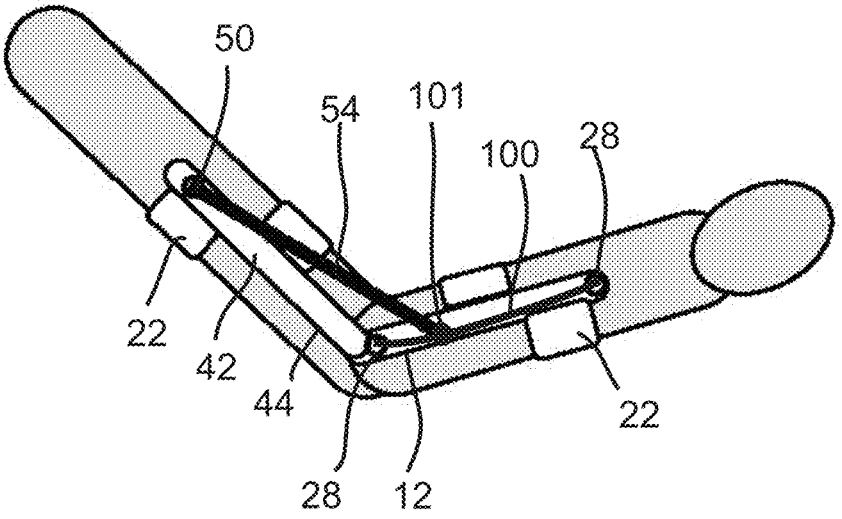
FIG. 7 is a diagram similar to FIG. 1 illustrating a roller on a flexible wire
Figure 8:
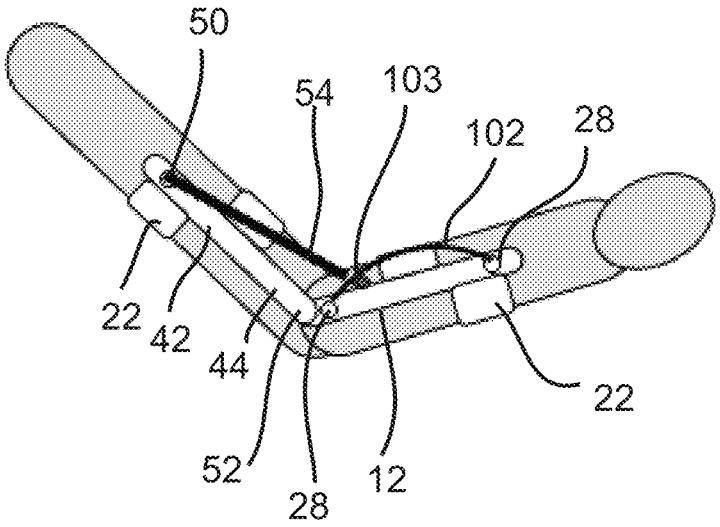
FIG. 8 is a diagram similar to FIG. 1 illustrating a roller on a curved rail.

A guide 24 extends along the rail 14. A link 26 is captive on the guide 24, but is free to slide along the guide 24 between end stops 28. In the interests of simplicity, the guide 24 is shown in FIGS. 1 to 3 as a straight rod. However, it could alternatively be a curved rod, or a flexible wire with some slack in the wire. FIG. 7 illustrates an embodiment with a flexible wire 100 with a roller 101 that rolls along the wire. FIG. 8 illustrates an embodiment with a curved rod 102 and a roller 103 that rolls along the rod.

A second frame 42 comprises a second rail 44 that in use extends along a patient's upper arm 46 from the elbow 18 about halfway to the shoulder 48, and one or more straps or clamps 22 that secure the second rail 44 in an essentially fixed position relative to the upper arm 46. An anchorage 50 is mounted on the second rail 44. The anchorage 50 may be movable along the second rail 44 for adjustment, but in use the anchorage 50 is fixed relative to the second rail 44, and therefore at a fixed distance from the elbow 18.

At the elbow 18, the first rail 14 and the second rail 44 are connected by a hinge 52. The hinge 52 is aligned to be substantially coaxial with the axis of pivoting of the patient's elbow 18, so that the rails 14 and 44 do not move up or down the arm to any appreciable extent as the elbow 18 flexes.

A spring 54 is attached to the sliding link 26 on the forearm and to the anchorage 50. The spring 54 is a tension spring, and is sufficiently short to be in tension at all normal positions of the forearm 16 relative to the upper arm 46, and at all normal positions of the sliding link 26 on the guide 24, as is discussed in more detail below.

As shown in FIG. 1, with the arm straight, the spring 54 lies roughly parallel to the upper arm 46, with the slider 26 close to the elbow, against the end-stop 28. In that position, the spring has very little leverage, and thus very little torque about the elbow 18. There is thus very little force from the spring 54 tending to raise the forearm 16. The pre-tension of the spring is largely absorbed by compression of the hinge 52 and the second rail 44.

The slider 26 is not exactly at the elbow, so as the elbow 18 is bent, the slider moves slightly out of line with the second rail 44, as shown in FIG. 2. However, as long as the slider 26 remains against the end stop 28, the leverage, and therefore the torque, exerted by the spring 18 remain small.

As the elbow 18 flexes, the angle between the rail 24 and the spring 54 changes. Beyond a certain angle of flexing of the elbow 18, as shown in FIG. 3, and as will be explained in more detail below, the tension in the spring 54 pulls the slider 26 away from the end-stop 28. Then, the slider 26, with the end of the spring 54, moves along the guide 24 on the forearm 16, away from the elbow 18. The further the slider 26 moves, the more leverage the spring 54 gains around the elbow 18, with the result that the spring force creates a higher torque at the elbow 18 than in FIG. 1. Thus, the further bent the elbow 18 is, the more assistance the patient receives from the spring 54, even though the spring is contracting, and therefore its actual tension force is decreasing. That progressive increase is exactly what is required when the patient is attempting to raise his or her hand 20, and anything held in the hand, by flexing the elbow 18.

The resulting assistance provided by the spring acts only above a certain angle then ramps up as the hand gets closer to the mouth. The spring can be viewed as a biceps surrogate that acts in concert with the triceps to co-contract to obtain the desired movement.

Torque Shaping

Simply attaching the ends of a spring 54 to two fixed points (one on the upper arm 46 and one on the forearm 16) is not sufficient to achieve the desired pattern of torque at the elbow 18; as the elbow 18 bends, the spring 54 relaxes, and the torque is not sufficiently high to get the hand 20. For this reason the present device allows the end of the spring 54 to slide along the forearm 16 as the elbow 18 bends naturally. That provides a greater torque due to a bigger moment arm.

Figure 5:
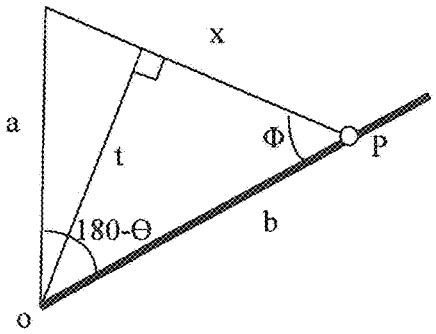
FIG. 5 is another force diagram.

The calculations are as follows, assuming that the patient's upper arm 46 is vertical, with the elbow below the shoulder. In FIGS. 4 and 5:

a=distance from elbow 18 to anchorage 50;

b=distance from elbow 18 to slider 26;

g=gravitational constant;

K=Spring stiffness;

l=distance from elbow 52 to center of mass of the forearm;

$M_0$=moment about the elbow;

m=mass of the forearm;

o=position of elbow 18;

P=distance from elbow 52 to proximal limit of slider 26 (end-stop 28);

s=position of slider 26;

t=perpendicular distance from point o to line of spring 54;

x=stretch of the spring;

θ=elbow angle measured with respect to the upper arm (vertical);

Φ=angle at P included between forearm and spring.

Figure 6:
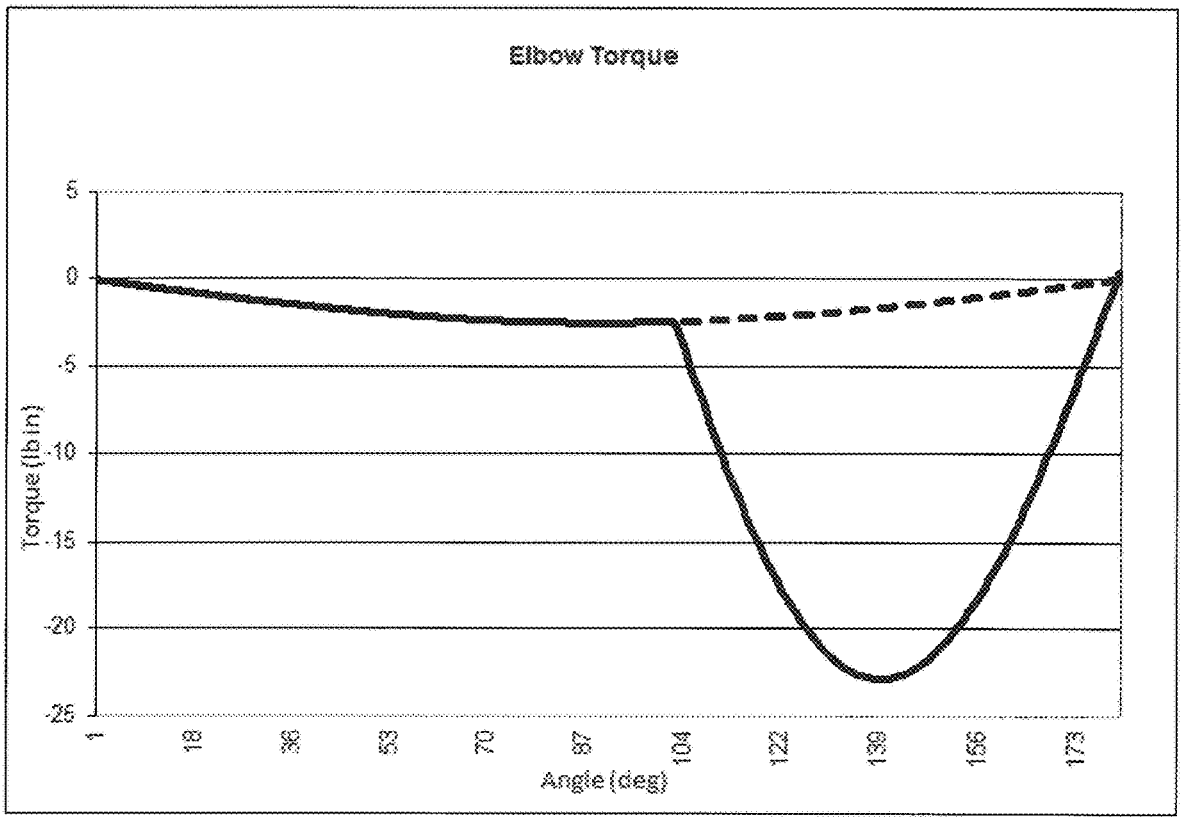
FIG. 6 is a graph of torque against elbow angle.

As the elbow goes from θ=0 to θ=140 deg (approx.) the lower end of the spring goes through two stages:

Stage 1. The lower end of the spring is at point P in FIG. 6, in contact with the end stop 28 nearest the elbow 18. The torque on the elbow for this stage can be derived as follows:

The moment about point $o$ from FIG. 6 is (1)

$$\sum M_o = mgl\cos(\theta - 90) - Kxt$$

And from FIG. 7 $x^2 = a^2 + b^2 - 2ab\cos(180 - \theta)$

Therefore $x = \sqrt{a^2 + b^2 + 2ab\cos\theta}$ (2)

And from FIG. 7 $\sin\phi = \frac{t}{b}$ and $\frac{a}{\sin\phi} = \frac{x}{\sin(180 - \theta)}$ Therefore $\frac{ab}{t} = \frac{x}{\sin\theta}$, so $t = \frac{ab\sin\theta}{x}$ (3)

Substituting equations (2) and (3) into (1), (4)

yields: $\sum M_o = \sin\theta(mgl - Kab)$

In the interests of simplicity and clarity, Equations (1) and (2) assume that the unstretched length of the spring 54 between the slider 26 and the attachment point 50 is 0. If the spring 54 has unstretched length within that space, appropriate refinements can be made to the calculation.

Stage 2. As the forearm elevates it gets to a point where the bottom of the spring begins to slide along the rail. As this happens the moment (torque) is calculated differently:

The transition for stage 1 to stage 2 occurs when $$\cos(180 - \theta) = \frac{b}{a} \text{ or } \theta \geq \cos^{-1}\left(\frac{-b}{a}\right).$$

If a slack wire (FIG. 7) or a suitably curved rail (FIG. 8) is used for the guide 24 instead of a straight rail, the slider 26 will tend to start moving sooner, and will move more gradually, than with the straight rail assumed in the equations. The more gradual movement is in many practical implementations desirable, and may justify the more complicated construction.

In the interests of simplicity and clarity, the equations ignore friction. Significant friction will cause the slider to start moving later. Depending on the exact conditions, friction may cause a more gradual movement, which is likely to be desirable, or a sudden breakaway and a violent jerk, which is usually not desirable. It is at present preferred to keep the friction low. The slider 26 may therefore be provided with a roller, or a facing of low-friction material.

So when $\theta \geq \cos^{-1}\left(\frac{-b}{a}\right)$

From FIG. 6, $\sum M_o = mgl\cos(\theta - 90) - Kxs$ (5)

Also $\cos(180 - \theta) = \frac{s}{a}$, therefore $s = -a\cos\theta$ (6)

And $a^2 = x^2 + s^2$, therefore $x = a\sin\theta$ (7)

Plugging equations (6) and (7) into (5) yields $$\sum M_o = mgl\sin\theta + Ka^2\sin\theta\cos\theta \quad (8)$$

Equations (4) and (8) can be plotted against θ and a typical graph is shown in FIG. 6.

The graph corresponds to the following values:

Weight of subject=100 lbs (45 kg);

b=1 in (25 mm);

a=4.5 in (115 mm);

K=3 lb/in (525 N/m);

L=4 in (100 mm).

FIG. 6 illustrates the increase in the elbow torque above a certain angle. At approximately 104 deg of elbow rotation, the spring applies a much higher torque as seen by the change in the curve: the broken line indicates the corresponding torque curve without the boost device. The resulting sensation is that the elbow is given a boost as it rotates past a certain angle. This facilitates eating and getting the hand close to the mouth and head.

Although a specific embodiment has been described, those of skill in the art will understand that other forms of the device are possible without departing from the scope of the invention as defined in the appended claims.

For example, the guide 24 and slider 26 could be on the upper arm, and the fixed anchorage 50 could be on the forearm.

The guide 24 could be angled with respect to the forearm so that the boost occurs at an earlier angle.

The proximal limit (point P) of the slider 26 on the guide 24 could be made adjustable, for example, by providing a movable end-stop 28 clamped onto the guide 24. The point of attachment 50 of spring 54 to second rail 44 could be made adjustable. A larger number of adjustable features enables a standard device to be more accurately adjusted to the needs and desires of an individual patient. However, that also makes correct setup of the device more complicated. Also, a device with low profiles and smoothly curved surfaces may be preferred, both aesthetically and practically, so that the device does not catch on things; and a low, sleek shape is easier to achieve if you do not have a lot of adjusters.

For example, the hinge 52 is not actually necessary, although it has been found to be highly desirable in practice, to prevent the guide 24 and the anchorage 50 being pulled together by the tension in the spring 54, and the anchorage 50 creeping towards the elbow.

For example, an elbow assist device for a human being has been described by way of example, but a device embodying the same principles could in some circumstances be useful for other joints, for example, to help flex a human knee during gait, or to assist in raising an arm at the shoulder.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. The various embodiments and elements can be interchanged or combined in any suitable manner as necessary.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents

The invention claimed is:

1. A joint boost device, comprising:

first and second frames, attachable to first and second body parts of a patient with an attachment device mounted on each of the first and second frames, wherein the first and second body parts are connected by a joint;

a guide mounted on the first frame and configured to extend generally towards and away from the joint when the device is attached to the patient;

a link mounted on the guide for movement along the guide, and a spring acting in tension between the link and a point on the second frame remote from said joint;

wherein the first frame comprises a first rail and the guide comprises a flexible wire attached to two points spaced apart along the first rail.

2. The joint boost device of claim 1, which is an elbow boost device, and wherein the first and second body parts are an upper arm and a forearm of the patient.

3. The joint boost device of claim 2, wherein the first frame is arranged to be attached to the forearm of the patient with the attachment device mounted on the first frame and the second frame to the upper arm with the attachment device mounted on the second frame.

4. The joint boost device of claim 1, further comprising a hinge connecting the first and second frames, and arranged to be positioned with an axis of rotation of the hinge coaxial with an axis of rotation of said joint.

5. The joint boost device of claim 1, wherein the second frame comprises a second rail configured to extend generally towards and away from said joint when the device is attached to the patient, and wherein the spring is attached at an anchorage that is at a position adjustable along the second rail.

6. The joint boost device of claim 1, wherein each of the first and second frames has a first and second end and an axis extending between the first and second ends, the first and second frames being connected to one another at their respective first ends by a hinge, and wherein the link moves along the guide in the first frame in a direction that is oblique relative to the axis of the second frame.

7. The joint boost device of claim 1, wherein the first and second frames are connected to one another by a hinge, and wherein an end position of the guide nearest to the hinge is adjustable.

8. The joint boost device of claim 2, wherein:

the first and second frames are each configured for attachment to a respective one of the upper arm and the forearm of the patient through use of the attachment device on each of the first and second frames;

the guide is mounted on the first frame and extends generally along a portion of the first frame; and the link moves along the guide while subject to a tensile force imposed by the spring on the link as the patient bends and straightens the elbow.

9. A method of assisting the biceps to flex an elbow of a patient, comprising:

providing a joint boost device according to claim 1;

attaching the first and second frames to respective ones of the upper and lower arms of the patient using the attachment device mounted on each of the first and second frames;

wherein the spring imposes the tensile force on the link throughout all movement of the link along the guide;

permitting the link to move along the guide under an influence of the tension imposed by the spring as the first and second frames move relative to one another.

* * * * *